US007533721B2

(12) United States Patent
Sorhus

(10) Patent No.: US 7,533,721 B2
(45) Date of Patent: May 19, 2009

(54) MILLABLE PRE-INSTALLED PLUG

(75) Inventor: Atle J. Sorhus, Stavanger (NO)

(73) Assignee: Baker Hughes Incorporated, Houston, TX (US)

( * ) Notice: Subject to any disclaimer, the term of this patent is extended or adjusted under 35 U.S.C. 154(b) by 68 days.

(21) Appl. No.: 11/365,709

(22) Filed: Mar. 1, 2006

(65) Prior Publication Data

US 2007/0204986 A1 Sep. 6, 2007

(51) Int. Cl.
*E21B 33/12* (2006.01)

(52) U.S. Cl. ..... 166/192; 166/317; 166/203; 138/89

(58) Field of Classification Search ..... 166/164, 166/192, 317, 179, 181, 203; 138/89
See application file for complete search history.

(56) References Cited

U.S. PATENT DOCUMENTS

| | | | | | |
|---|---|---|---|---|---|
| 1,883,074 | A | * | 10/1932 | Stone | 166/194 |
| 2,180,605 | A | | 11/1939 | Otis | |
| 2,259,232 | A | * | 10/1941 | Stone | 175/325.5 |
| 2,868,297 | A | | 1/1959 | Lamberson, Jr. | |
| 3,029,875 | A | * | 4/1962 | Moller | 166/317 |
| 3,038,539 | A | * | 6/1962 | Bloom et al. | 166/264 |
| 3,642,064 | A | | 2/1972 | Rosenthal | |
| 3,662,822 | A | * | 5/1972 | Wakefield, Jr. | 166/335 |
| 3,980,134 | A | * | 9/1976 | Amancharla | 166/133 |
| 4,434,816 | A | * | 3/1984 | Di Giovanni et al. | 138/109 |
| 4,487,228 | A | * | 12/1984 | Waldo et al. | 138/96 T |
| 4,574,882 | A | * | 3/1986 | Szarka | 166/70 |
| 4,842,062 | A | * | 6/1989 | Schneider et al. | 166/154 |
| 5,020,590 | A | * | 6/1991 | McLeod | 166/77.4 |
| 5,511,617 | A | * | 4/1996 | Snider et al. | 166/291 |
| 5,936,187 | A | * | 8/1999 | Miller et al. | 102/333 |
| 5,947,204 | A | * | 9/1999 | Barton | 166/317 |
| 5,992,524 | A | | 11/1999 | Graham | |
| 6,135,206 | A | | 10/2000 | Gano et al. | |
| 6,334,488 | B1 | | 1/2002 | Freiheit | |
| 6,349,771 | B1 | * | 2/2002 | Luke | 166/386 |
| 6,651,738 | B1 | * | 11/2003 | Solfronk et al. | 166/133 |
| 6,945,326 | B2 | * | 9/2005 | Mikolajczyk | 166/153 |
| 2005/0103493 | A1 | | 5/2005 | Stevens et al. | |

FOREIGN PATENT DOCUMENTS

| | | | |
|---|---|---|---|
| GB | 2287267 | A | 9/1995 |
| WO | 2004053288 | A1 | 6/2004 |

OTHER PUBLICATIONS

Total Catcher Offshore AS, Norway, Tubing Disappearing Plug—TDP; http://www.total-catcher.com/plug_tdsp.html; 3 pages.

* cited by examiner

*Primary Examiner*—Kenneth Thompson
(74) *Attorney, Agent, or Firm*—Steven Rosenblatt

(57) ABSTRACT

A tubing plug is preinstalled in a premium connection that allows support for the plug outside the drift dimension of the tubulars above and below. The plug is supported in a rotationally locked manner to avoid turning when being milled out. The plug shape internally comprises gentle sloping walls rather than surfaces in alignment with the longitudinal axis of the tubular to allow smaller cuttings to be produced that can be caught on a magnetic sub or circulated to the surface. Because the plug is supported in a zone outside the drift dimension of the adjacent tubulars, milling out the plug does not reduce the drift of the tubular assembly in which the plug was initially mounted. Seals can be provided for bubble tight sealing around the plug.

18 Claims, 2 Drawing Sheets

MILLABLE PRE-INSTALLED PLUG

FIELD OF THE INVENTION

The field of this invention is tubular plugs and more particularly plugs to temporarily obstruct a tubular in a bore while a lateral is drilled and removable at a later time preferably without reduction of drift dimension of the tubular.

BACKGROUND OF THE INVENTION

Plugs have been used in tubulars downhole to temporarily close off a wellbore until another procedure such as drilling a lateral was completed. Plugs have been placed below whipstocks and even integrated into whipstocks as shown in U.S. Pat. Nos. 6,135,206 and 5,992,524. Other designs such as those offered by Total Catcher Offshore AS of Norway have incorporated a pup joint into which a sealed plug is installed. The pup joint is placed in the tubular string when it is made up. It features a firing system for an explosive charge that is hydraulically actuated or timer set to break the plug. An emergency release of the plug is stated to occur with a wireline emergency shoot down tool. This plug is referred to as a disappearing plug made of glass that as a result of setting off the explosive charge disintegrates into sand like particles. While such is the advertised performance of such a plug actual attempts to remove the plug when no longer required have resulted in the plug not completely disintegrating so as to partially obstruct the bore and reduce production from the previously isolated tubular. Another issue was large chunks forming that could not be removed from the wellbore or that would fall further into the well and interfere with later production.

Accordingly, the present invention relates to a plug that is configured to be drilled or milled in a manner that will present small cuttings that can be captured on an adjacent magnetic sub or circulated to the surface. The plug is secured in a manner to prevent rotation during the mill out process and to leave a drift dimension in the tubular at least as large as the drill or mill that was run in to remove the plug in the first place. Those and other features of the present invention will be more apparent to those skilled in the art from a review of the description of the preferred embodiment and the drawing as well as the claims, which are illustrative of the full scope of the invention.

SUMMARY OF THE INVENTION

A tubing plug is preinstalled in a premium connection that allows support for the plug outside the drift dimension of the tubulars above and below. The plug is supported in a rotationally locked manner to avoid turning when being milled out. The plug shape internally comprises gentle sloping walls rather than surfaces in alignment with the longitudinal axis of the tubular to allow smaller cuttings to be produced that can be caught on a magnetic sub or circulated to the surface. Because the plug is supported in a zone outside the drift dimension of the adjacent tubulars, milling out the plug does not reduce the drift of the tubular assembly in which the plug was initially mounted. Seals can be provided for bubble tight sealing around the plug.

DETAILED DESCRIPTION OF THE PREFERRED EMBODIMENT

Figure 1:
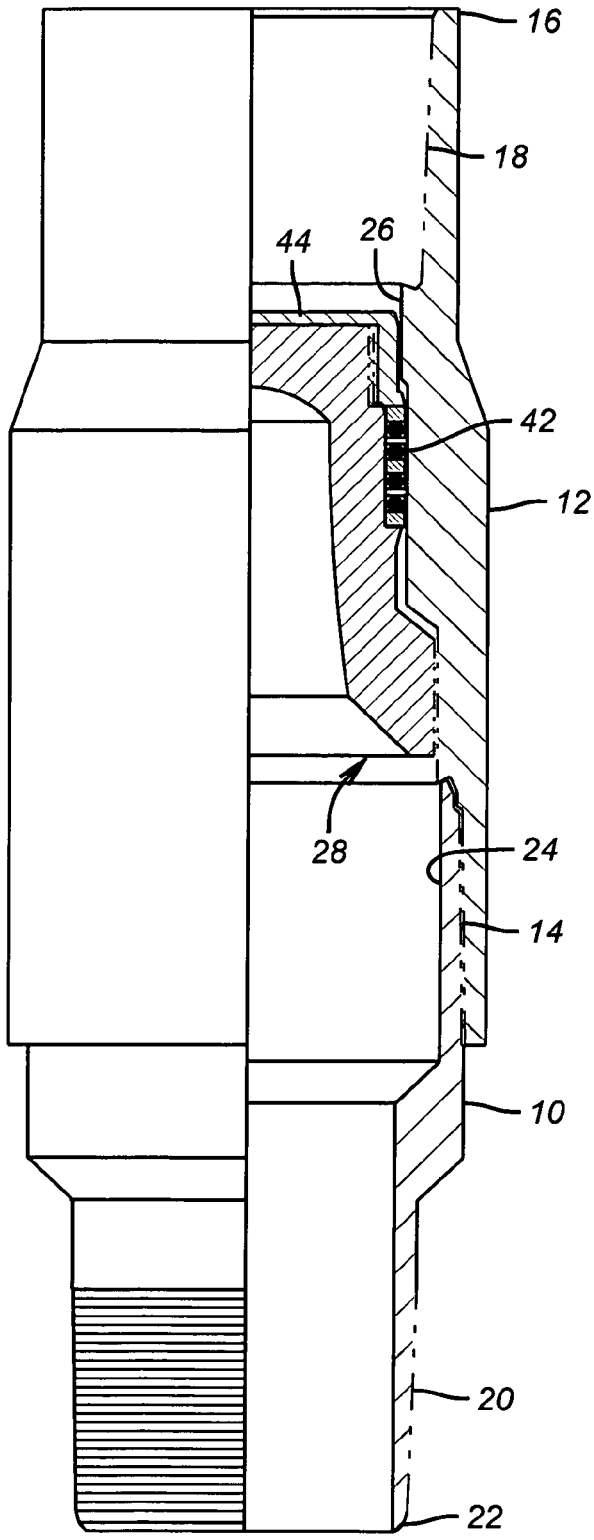
FIG. 1 is a section view of an assembled plug in a tubular connection.

FIG. 1 illustrates a pin 10 secured to the box 12 at thread 14. The upper end 16 of the box 12 has a premium thread 18 to secure a tubular string (not shown) above. Pin 10 has a premium thread 20 near its lower end 22. When assembled, as shown in FIG. 1, a recess 24 is formed that has a greater diameter than the drift dimension 26 in the box 12. The plug 28 is preferably secured in a manner that will prevent rotation when it is drilled or milled out within the recess 24. The fixation against rotation can be varied to comprise among other techniques splines, dogs, or opposite hand threads from the direction of mill or drill rotation.

Figure 4:
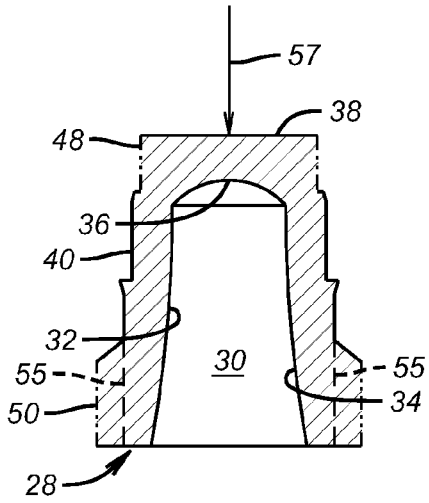
FIG. 4 is a section of the plug.

The plug 28 is preferably made from materials that are compatible with well temperatures and fluids and is relatively easy to mill through as well. The plug 28 is preferably made of at least one of a metallic, a non-metallic, plastic, ceramic and a composite material. Referring to FIG. 4, the plug 28 has a hollow interior 30 that preferably has sloping walls 32 and 34 with respect to a longitudinal axis of the plug 28. A curved surface 36 joins walls 32 and 34 near the top surface 38 of the plug 28 so that collectively a concave shape is defined. In reality walls 32 and 34 are simply a continuous circular sloping wall but other configurations are within the scope of the invention. The sloping walls 32 and 34 coupled with the curved surface 36 that joins them have been found to create very small cuttings that can be easily captured by an adjacent magnetic sub (not shown) or can be readily circulated to the surface and screened out. The upper surface 38 being preferably flat was not found to create issues with large cuttings that could fall into the tubular as the plug 28 is milled out. Of course, the hollow interior also speeds up the milling or drilling process.

Figure 5:
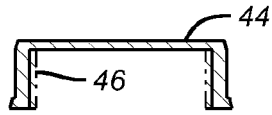
FIG. 5 is a section of the retaining cap for a seal assembly on the plug.
Figure 3:
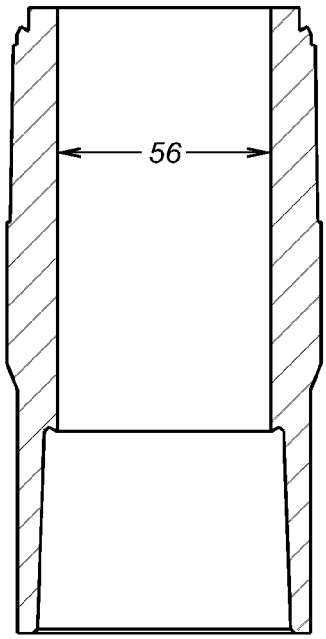
FIG. 3 is a section of the male component of the connection holding the plug.

On the exterior of the plug 28 is a surface 40 that accepts a seal assembly 42 that is shown in FIG. 1. Cap 44 shown in FIGS. 1 and 5 has an internal thread 46 to secure the cap 44 to thread 48 on the plug 28. When so secured, the seal assembly 42 is secured at surface 40.

Figure 2:
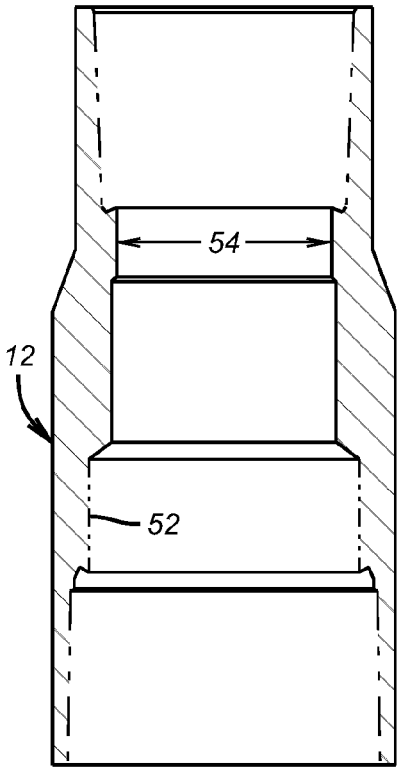
FIG. 2 is a section of the female component of the connection holding the plug.

One way to secure the plug 28 is to provide a left hand thread 50 on it to thread into mating thread 52 on box 12. Items 50 and 52 in FIGS. 4 and 2 are also intended to schematically illustrate lugs in mating grooves as an alternative to mating threads described above. When milling occurs, the drill or mill represented by arrow 57 passes through the drift dimension 54 on the box 12 as well as the preferably same drift dimension 56 on the pin 10. While this could leave a ring shaped remnant of plug 28 schematically illustrated by dashed lines 55 still secured to thread 52 on box 12 the opening size or plug drift dimenesion represented by dashed lines 55 should be at least as large as the mill or drilled that just passed through and could be somewhat larger approaching the drift dimensions 54 and 56. This result happens even if the anti-rotation mechanism is something other than a left handed thread.

The sub that holds the plug 28 supports it in a recess to allow drilling or milling to present a drift dimension at least as large as 54 or 56. The plug 28 is rotationally locked for mill out or drill out. The plug is preferably hollow and made of a material that expedites mill out or drill out. The wall on the plug underside features angled orientation to the longitudinal axis with an arcuate crown 36. These features are designed to create smaller cuttings that can be more easily captured with a magnetic sub or circulated to the surface rather than falling down the tubular or remaining in place and hampering future production. The design eliminates the uncertainties of the prior designs that used glass and an explosive to make the plug hopefully disappear. This design is way cheaper to produce and can reliably remain in place for long periods of time. It can be effectively removed with assurance that the drift dimension will be clear after the removal.

The above description is illustrative of the preferred embodiment and many modifications may be made by those skilled in the art without departing from the invention whose scope is to be determined from the literal and equivalent scope of the claims below.

I claim:

1. A removable tubular plug, comprising:

a pin and box components extending from ends of tubulars securable to each other and defining at least a portion of a tubing string for placement in a wellbore, said string, at a location away from said ends of said tubulars, having a drift diameter therethrough;

a plug having an outermost dimension and supported at said outermost dimension by contact with a recess formed by at least one of said pin and box, said recess, where said contact with said outermost dimension occurs, is a greater dimension than said drift diameter;

said outermost dimension of said plug is rotationally locked with said plug being not removable from said pin or box, when secured to each other, without destruction thereof.

2. The plug of claim 1, wherein:

a left hand thread locks the plug rotationally when milled or drilled by a tool turning the opposite direction.

3. The plug of claim 1, wherein:

said plug leaves a drift dimension as large as said drift dimension in said pin and box after it is drilled or milled out.

4. The plug of claim 3, wherein:

said drift dimension left by said plug after mill out or drill out includes some portion of it that remains in said recess.

5. The plug of claim 1, wherein:

said plug is made of a material that is readily milled or drilled.

6. The plug of claim 5, wherein:

said plug is made of at least one of a metallic, a non-metallic, plastic, ceramic and a composite material.

7. A removable tubular plug, comprising:

a pin and box components securable to each other and defining a passage having a drift diameter therethrough;

a plug supported by at least one of said pin and box and in a recess formed by at least one of them where said recess is a greater dimension than said drift diameter, said plug blocking flow from downhole in said passage when supported in said recess;

said plug is supported in said recess in a rotationally locked manner;

splines lock said plug rotationally.

8. A removable tubular plug, comprising:

a pin and box components extending from ends of tubulars securable to each other and defining at least a portion of a tubing string for placement in a wellbore, said string having a drift diameter therethrough;

a plug supported by at least one of said pin and box and in a recess formed by at least one of them where said recess is a greater dimension than said drift diameter;

said plug is removably supported in said recess in a rotationally locked manner;

said plug has an elongated shape defining a top side that initially is drilled or milled away and an underside that is concave.

9. The plug of claim 8, wherein:

said concave underside features a sloping wall with respect to a longitudinal axis of said plug.

10. The plug of claim 9, wherein:

said concave underside features an arcuate surface between said sloping wall and a top end of said plug.

11. The plug of claim 10, wherein:

said top end is substantially flat.

12. The plug of claim 11, wherein:

said top end comprises a cap that retains a seal assembly to said plug.

13. The plug of claim 12, wherein:

said cap is flat and is secured to said plug with threads.

14. A removable tubular plug, comprising:

a pin and box components extending from ends of tubulars securable to each other and defining at least a portion of a tubing string for placement in a wellbore, said string having a drift diameter therethrough;

a plug supported by at least one of said pin and box and in a recess formed by at least one of them where said recess is a greater dimension than said drift diameter;

said plug is removably supported in said recess in a rotationally locked manner;

said plug has an elongated shape defining a top side that initially is drilled or milled away and an underside that is concave;

said concave underside features a sloping wall with respect to a longitudinal axis of said plug.

15. A removable tubular plug, comprising:

a pin and box components securable to each other and defining a drift diameter therethrough;

a plug supported by at least one of said pin and box and in a recess formed by at least one of them where said recess is a greater dimension than said drift diameter;

said plug is supported in said recess in a rotationally locked manner;

said plug has an elongated shape defining a top side that initially is drilled or milled away and an underside that is concave;

said concave underside features a sloping wall with respect to a longitudinal axis of said plug.

16. The plug of claim 15, wherein:

said concave underside features an arcuate surface between said sloping wall and a top end of said plug.

17. The plug of claim 16, wherein:

said plug leaves a drift dimension as large as said drift dimension in said pin and box after it is drilled or milled out.

18. The plug of claim 17, wherein:

said drift dimension left by said plug after mill out or drill out includes some portion of it that remains in said recess.

* * * * *